US008863769B2

(12) United States Patent
Andersen et al.

(10) Patent No.: US 8,863,769 B2
(45) Date of Patent: Oct. 21, 2014

(54) SPRAYER SEATING ASSEMBLY

(75) Inventors: Terrence J. Andersen, Sheboygan, WI (US); Michael R. Bates, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 753 days.

(21) Appl. No.: 12/259,742

(22) Filed: Oct. 28, 2008

(65) Prior Publication Data

US 2010/0102177 A1 Apr. 29, 2010

(51) Int. Cl.

| | |
|---|---|
| ***A62C 11/00*** | (2006.01) |
| ***B05B 11/06*** | (2006.01) |
| ***E03C 1/04*** | (2006.01) |

(52) U.S. Cl.

CPC ..... *E03C 1/0401* (2013.01); *E03C 2001/0416* (2013.01); *E03C 2001/0415* (2013.01); *E03C 2201/50* (2013.01); *E03C 1/0404* (2013.01)

USPC ..... 137/359; 4/675

(58) Field of Classification Search

USPC ..... 137/359; 239/600; 285/280, 282; 4/675, 4/678, 615, 616, 625, 567, 570

See application file for complete search history.

(56) References Cited

U.S. PATENT DOCUMENTS

| | | | | |
|---|---|---|---|---|
| 738,503 | A * | 9/1903 | Waters | 285/321 |
| 2,468,315 | A * | 4/1949 | Wagner | 285/179 |
| 4,139,221 | A * | 2/1979 | Shotbolt | 285/18 |
| 4,478,438 | A * | 10/1984 | Elorriaga, Jr. | 285/276 |
| 5,025,510 | A | 6/1991 | Basile | |
| 5,718,464 | A * | 2/1998 | Mark | 285/321 |
| 5,758,690 | A | 6/1998 | Humpert et al. | |
| 5,873,387 | A * | 2/1999 | Weber et al. | 137/615 |
| 5,934,325 | A | 8/1999 | Brattoli et al. | |
| 6,183,636 | B1 * | 2/2001 | Bowers et al. | 210/232 |
| 6,220,297 | B1 | 4/2001 | Marty et al. | |
| 6,381,770 | B1 | 5/2002 | Raisch | |
| 6,471,141 | B2 | 10/2002 | Smith et al. | |
| 6,807,983 | B1 * | 10/2004 | Erickson | 137/359 |
| D533,622 | S * | 12/2006 | Ross et al. | D23/209 |
| 2003/0084937 | A1 * | 5/2003 | Burns et al. | 137/359 |
| 2004/0010848 | A1 * | 1/2004 | Esche | 4/675 |
| 2009/0199382 | A1 * | 8/2009 | Heaton | 29/270 |

FOREIGN PATENT DOCUMENTS

| | | |
|---|---|---|
| EP | 736715 | 10/1996 |
| EP | 1036973 | 9/2000 |
| EP | 898109 | 5/2003 |

OTHER PUBLICATIONS

Seven pages of a PCT search report dated Feb. 25, 2010 in a corresponding application PCT/US2009/005827.

* cited by examiner

*Primary Examiner* — Len Tran
*Assistant Examiner* — Chee-Chong Lee
(74) *Attorney, Agent, or Firm* — Foley & Lardner LLP

(57) ABSTRACT

A sprayer seating assembly is disclosed for more securely docking a sprayer head to an escutcheon positioned on a countertop or the like. The escutcheon has a bore extending there through and a recess adjacent the bore. A sprayer head is linked to a supply hose and has a recess adjacent a base portion of the sprayer head. A flexible snap member is mounted in one of the recesses such that it can flex at least partially into the other of the recesses when the recesses are aligned. The escutcheon forms a rest seat for the sprayer head and the flexible snap member assists in removably retaining the sprayer head against the rest seat.

20 Claims, 3 Drawing Sheets

SPRAYER SEATING ASSEMBLY

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

The present invention relates to sprayer heads associated with plumbing fittings such as faucets. More particularly it relates to assemblies for more securely docking a sprayer head between uses.

It is very common to associate a sprayer with a faucet used adjacent a kitchen sink. Most often, the sprayer is mounted separately from the faucet along a back mounting ledge of the sink or along a counter top behind or at a side of the sink. When the sprayer is not directly incorporated into the faucet it is sometimes referred to as a "side spray".

Of course, even such side sprays are typically linked to a faucet via various supply lines under the counter, often via a diversion system that operates such that triggering the side spray will automatically divert water from a faucet outlet to the sprayer head.

In other arrangements, the sprayer is of the pull-out type and is mounted on a part of the faucet itself. See e.g. U.S. Pat. No. 6,220,297. In this type of arrangement, the sprayer can be mounted on a horizontal portion of the faucet. However, in other designs it can be docked to a more vertical part of the faucet. See e.g. U.S. Pat. No. 5,934,325.

Regardless of whether the sprayer is docked between uses on a horizontal, partially vertical, or completely vertical surface, it is desirable that the sprayer appear to be properly positioned between uses. To facilitate this many sprayers have a weighted hose which tends to automatically drag the sprayer back to its seat when the sprayer is not held out from the seat. However, such a system can be defeated if too many boxes and bottles (e.g. dishwashing detergent and counter top cleaner) are stored under the sink and stop the weight from properly performing. Even when that is not the case, the sprayer head, as it docks, can sometimes catch in a position where it appears tilted.

In one approach to address these types of issues, a magnet was associated with the seat to use magnetic force to help properly seat the sprayer during docking. However, that placed some constraints on the materials which were used, and the effectiveness of this technique is somewhat limited if the spray head is accidentally bumped.

U.S. Pat. No. 5,758,690 described the use of a spring loaded ball to help facilitate positioning of a spout part. However, such a system is somewhat complicated to install, and in any event could suffer from maintenance and/or reliability concerns.

U.S. Pat. No. 6,381,770 disclosed the use of flex tabs on a spray head to facilitate mounting of a spray head through side walls of a mounting base. However, this significantly affected the aesthetics of the design.

Accordingly, there exists a need for improving the manner in which sprayers are docked to their seating areas between uses, without incurring these other types of concerns.

SUMMARY OF THE INVENTION

In one aspect the invention provides a sprayer seating assembly. The sprayer seating assembly includes an escutcheon suitable for positioning on a surface of a support. The escutcheon has a bore extending there through and a recess adjacent the bore. A sprayer head is linked to a supply hose and has a recess adjacent a base portion of the sprayer head.

The sprayer head and supply hose are positioned so that the supply hose extends out of a first end of the bore, and so that the sprayer head can at the same time extend beyond a second end of the bore. A flexible snap member is mounted in one of the recesses such that it can flex at least partially into the other of the recesses when the recesses are aligned. When the sprayer head is not in use, the escutcheon forms a rest seat for the sprayer head and the flexible snap member assists in removably retaining the sprayer head against the rest seat.

In one form the sprayer seating assembly is mounted to a support selected from the group consisting of essentially horizontal counter tops, essentially horizontal plumbing fixture walls, and essentially horizontal plumbing fitting walls. The escutcheon may be threaded to a supply tube. A clamping nut may be mounted to the supply tube such that the escutcheon and the clamping nut sandwich the support.

In another form the escutcheon may have a tapered portion along the bore to accommodate in docking fashion a tapered portion of the base portion of the sprayer head.

In yet another form the base portion of the sprayer head may be connected to the supply hose via a ball and socket connection. A filter may be positioned downstream of the ball and socket connection in the sprayer head.

In still yet another form, a plastic washer is positioned in the bore upstream of the sprayer head.

In other forms the flexible snap member may be a snap ring mounted in an annular recess in the escutcheon. The recesses in the escutcheon and on the sprayer head could both be essentially annular. The flexible snap member may be made of a plastic. The flexible snap member may have a radially inward edge that is pointed.

It should therefore be understood that the present invention provides a sprayer head assembly incorporating a flexible snap member to improve the docking of a sprayer head into an escutcheon. When docked, the flexible snap member helps to maintain the sprayer head in an upright position in the escutcheon. Without the flexible snap member, the sprayer head would have a greater tendency not to dock properly when inserted into the escutcheon.

Moreover, the flexible snap member will provide an improved tactile/assurance experience during the docking and undocking operations. When a user inserts or removes the sprayer head from the escutcheon, there is a defined moment at which the user feels a change in resistance. This change in resistance is an indication that the docking operation has worked and provides a sense of quality.

These modifications to a standard sprayer docking system can be achieved at low cost. Further, they can operate in a reliable manner long term.

The foregoing and other advantages of the present invention will become apparent from the following description. In that description reference will be made to the accompanying drawings which form a part thereof, and in which there is shown by way of illustration an example embodiment of the invention. However, the example embodiment is not intended as a representation of the full scope of the invention. Rather, the claims should be looked to for that purpose.

DETAILED DESCRIPTION OF THE INVENTION

Figure 1:
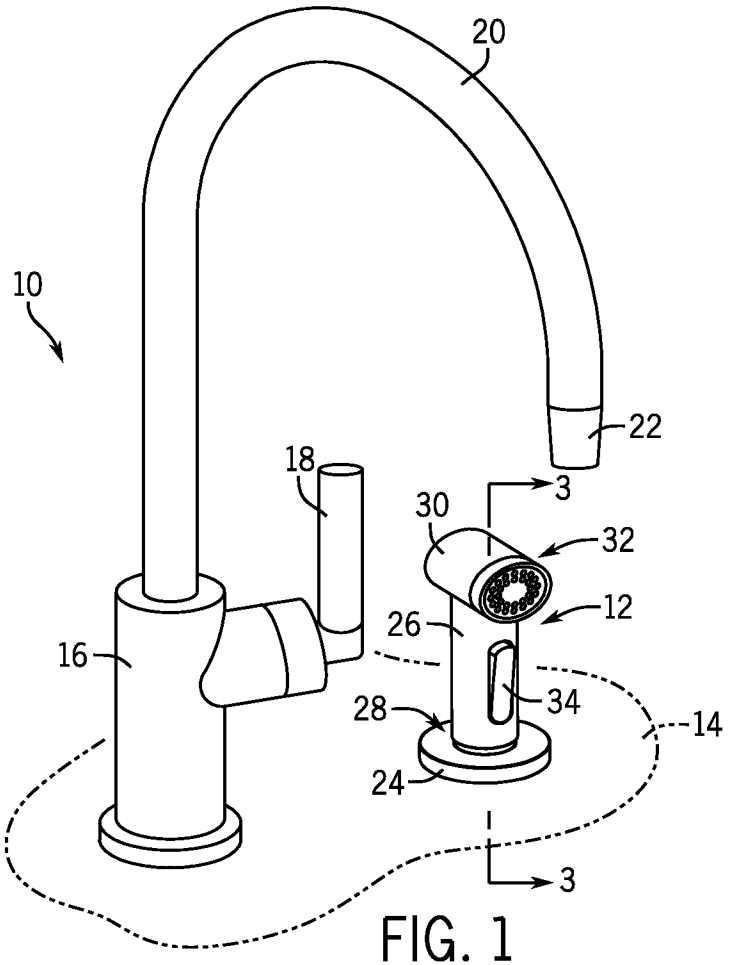
FIG. 1 is a left frontal perspective view of a sprayer head assembly embodying the present invention, positioned adjacent a faucet on a counter top.

Referring first to FIG. 1, a faucet 10 and a sprayer head 12 are shown on an upper surface of a counter top, support 14. The support 14 could alternatively be the rear edge of a kitchen sink, or could even be a portion of a faucet base.

The faucet 10 may have a conventional base 16 with a valve control handle 18 that extends out a side. In a well known manner, rotating the handle will control both volume and temperature. The faucet in this embodiment has a swing type J spout 20 which terminates in a conventional aerated outlet 22. When the spray is not being used, and the user turns the handle 18, water will flow from underneath the support 14, through the base 16, past a valve (not shown), to the spout 20, and then out the outlet 22.

In a conventional manner, and via a diverter associated with faucet 10, when the sprayer head 12 is triggered this will divert water from the operating faucet 10 to the sprayer head. When the triggering stops, water will restart through the spout 20, until the handle 18 turns the faucet off.

Figure 4:
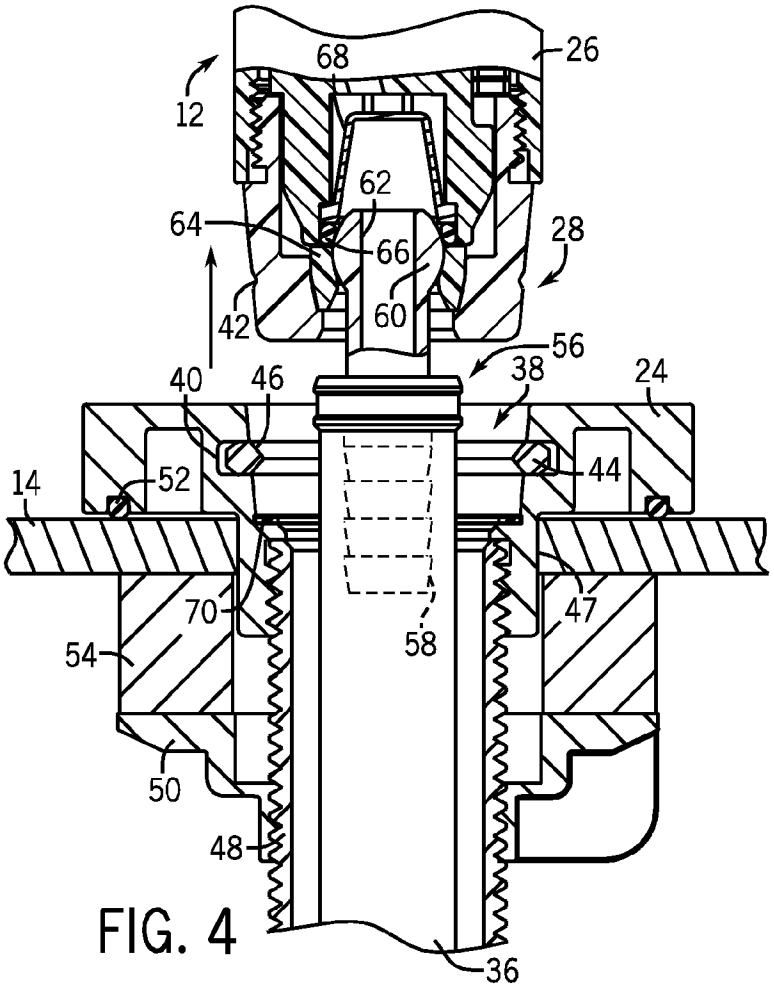
FIG. 4 is a view similar to FIG. 3, but with the sprayer head shown in a use position. 3, but in which the sprayer head is removed from the escutcheon.

Between uses the sprayer head 12 is docked in a decorative escutcheon 24 at a position to the side of the faucet 10. As depicted in FIG. 4, by pulling up on the sprayer head 12 with sufficient force the sprayer head will undock from the escutcheon head, and extra supply hose 36 will allow the sprayer head 12 to be optimally positioned and aimed. Although not required, a weight (not shown) on the supply hose 36 can be used to bias the sprayer head 12 back towards the docked position and reduce the difficulty of returning the supply hose 36 below the support 14.

The sprayer head 12 has a generally cylindrical main body 26 with a base portion 28, and a top portion 30 that has a plurality of nozzles 32. The sprayer head 12 includes a trigger 34 located on the side of the body 26.

The internal operation of the sprayer head 12 can be of a conventional well known type. For example, the trigger 34 can be outwardly biased to an off position in which no water flows from the nozzles 32. When the faucet 10 is on and the trigger 34 is squeezed, water will flow out of the nozzles 32 of the sprayer head 12. In another form, the sprayer head 12 may operate independently of the faucet 10. In this form, squeezing the trigger 34 will initiate spraying from the nozzles 32 whether or not the faucet 10 was initially running.

Figure 2:
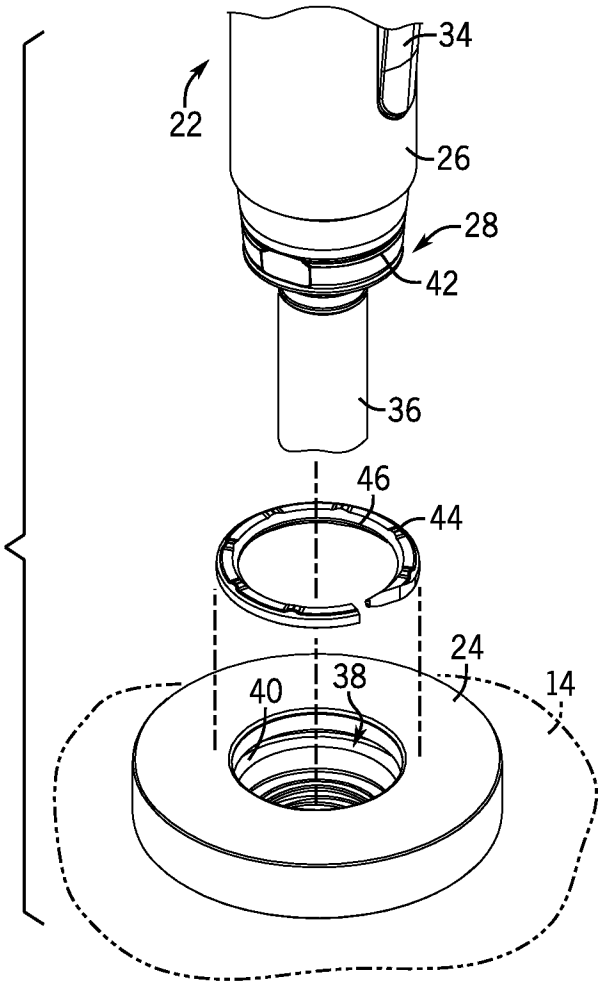
FIG. 2 is an enlarged partially exploded perspective view of the sprayer head.
Figure 3:
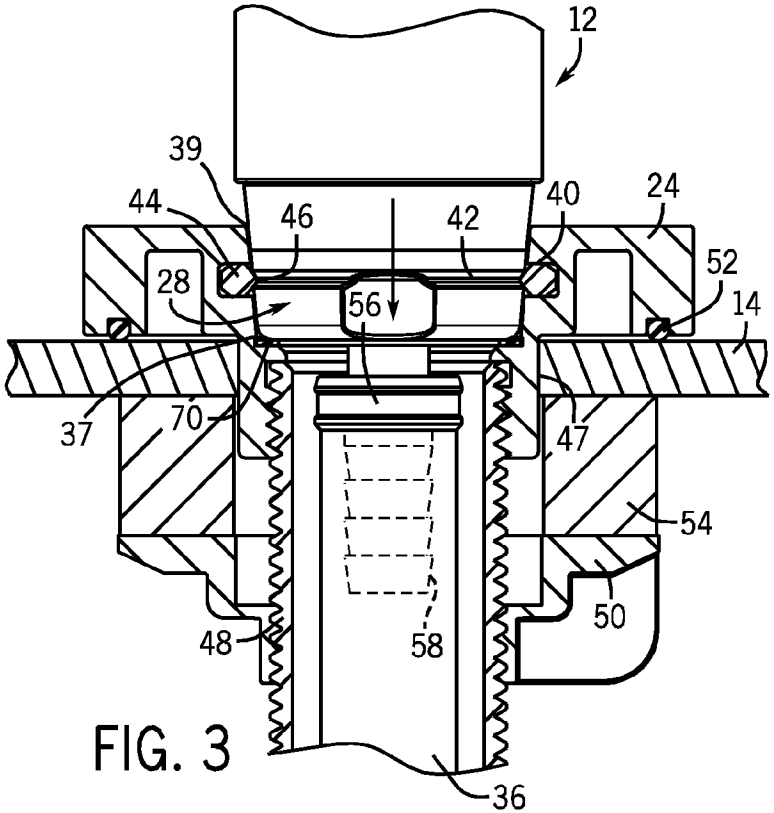
FIG. 3 is a partial cross-sectional view taken along line 3-3 of FIG. 1.

Referring next to FIGS. 2 and 3, it can be seen that the escutcheon 24 has an axial bore 38 extending there through, and a radially extending recess 40 adjacent to the bore 38. The bore 38 is shaped to receive the base portion 28 of the sprayer head 12. Along the base portion 28 of the sprayer head 12 there is a recess 42.

In FIG. 2 the supply hose 36 can be seen extending from the bottom of the base portion 28. The supply hose 36 is intended to extend down into the bore 38 and through the support 14 when the sprayer head is being used. The supply hose 36 also extends down out of a first or bottom end 37 of the bore 38 while, at the same time, the sprayer head 12 extends beyond the second or top end 39 of the bore 38.

Perhaps more importantly, a flexible snap member 44 is mounted and retained in the recess 40 in the escutcheon 24. Most preferably, the flexible snap member 44 is a snap C-ring. Alternatively, it can be other types of generally ring-shaped members, with an arcuate segment removed.

It should be appreciated that during the mounting of the flexible snap member 44 into the recess 40 of the escutcheon 24, the flexible snap member 44 is temporarily radially compressed and inserted into the bore 38, where it then returns to its original unstressed shape. The flexible snap member 44 has a radially inward edge 46 that is particularly shaped to engage the recess 42 of the sprayer head 12. The flexible snap member 44 may be made of plastic or any other material that is sufficiently elastic to withstand the deformation necessary to compress or expand during mounting and the docking operation.

The recess 40 of the escutcheon 24 and the recess 42 of the sprayer head 12 are both preferably annular. However, other shapes and types of recesses could be used to accommodate for other types of flexible snap members.

Although the flexible snap member 44 is shown as being mounted in a recess 40 of the escutcheon 24, that a flexible snap member could also be mounted in the recess 42 of the sprayer head 12. Thus, one of the recesses will have the flexible snap member initially mounted in it, while the other of the recesses will be used to receive the flexible snap member for retention purposes when the recesses are vertically aligned during docking. However, it is preferable to place the snap member in the escutcheon 24 initially as initially placing it on the base of the sprayer head leaves it somewhat more visible.

Referring now primarily to FIGS. 3 and 4, the escutcheon 24 is mounted over and somewhat in a hole 47 in the support 14. A tube or sleeve 48 is threaded to the bottom of the bore 38 of the escutcheon 24 until the sleeve 48 abuts a stop that restricts the further rotation of the sleeve 48. During installation, the escutcheon 24 and sleeve 48 are extended through the hole 47, and a clamping nut 50 is threaded onto the sleeve 48, thereby creating a sandwich construction which tightly holds these parts in place.

Figure 5:
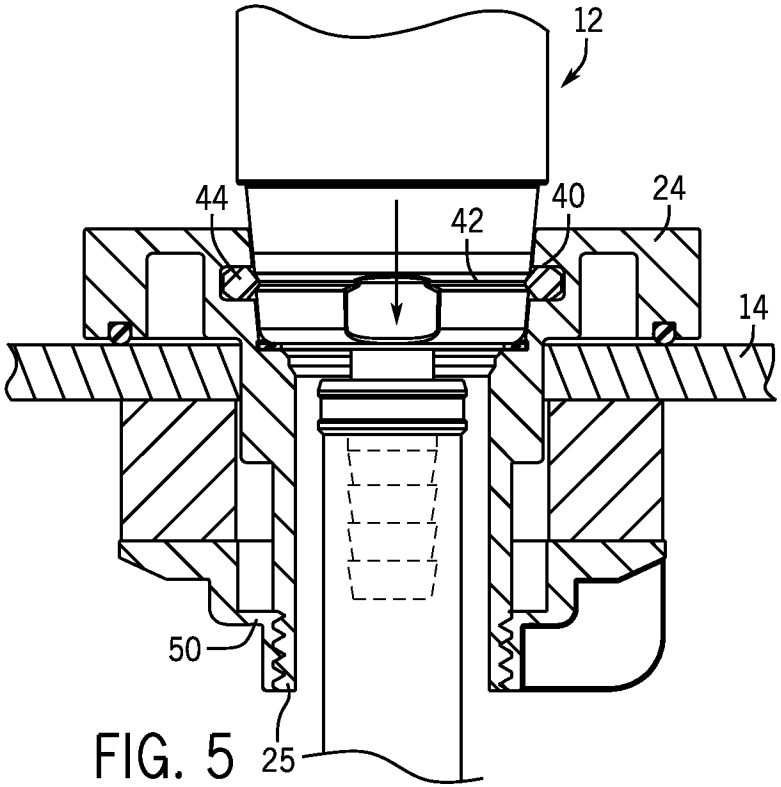
FIG. 5 is a partial cross-sectional view taken along line 3-3 of FIG. 1 showing an alternative exemplary embodiment.

Alternatively, as shown in FIG. 5, the escutcheon 24 may be integrally formed with the sleeve 48. In this form, the clamping nut 50 could be directly threaded to a portion 25 of the escutcheon 24.

As a refinement, to minimize damage to the support 14, and to inhibit leakage past the escutcheon, an o-ring 52 may be placed in a channel along the underside of the escutcheon 24 to contact the top side of the support 14. Also, a spacer 54 may be placed between the clamping nut 50 and bottom side of the support 14.

Referring now specifically mostly to FIG. 4, the sprayer head 12 is connected to the supply hose 36 via a ball and socket type joint. A connecting piece 56 has a first end with a multiple barb tube fitting 58, a second end with a ball joint portion 60, and a channel 62 placing the hose 36 in fluid communication with the sprayer head 12.

At one end, the supply hose 36 is fitted over the multiple barb tube fitting 58. At the other end, the ball joint portion 60 is placed in a socket joint portion 64 of the sprayer head 12. An o-ring 66 forms a seal between the ball joint portion 60 and the socket joint portion 64, so that any water is directed through a filter 68 placed downstream of the ball and socket joint and through the sprayer head 12.

This ball and socket joint allows the sprayer head 12 to rotate and pivot somewhat freely relative to the hose 36. If the sprayer head 12 was more rigidly connected to the supply hose 36, then certain types of movement may be difficult without twisting the supply hose 36.

Importantly, FIGS. 3 and 4 show details of the docking process and, in particular, how the flexible snap member 44 and tapered walls of the bore 38 and the base portion 28 assist in the docking process. In this regard, when the base portion 28 is docked in the bore 38 of the escutcheon 24, the flexible snap member 44 is expanded radially to grip around the recess 42 on the sprayer head 12.

When the base portion 28 of the sprayer head 12 is inserted into the bore 38, the flexible snap member 44 is expanded until it suddenly snaps to engage or snag the recess 42 of the base portion 28 when the recesses 40 and 42 align. In this position, the flexible snap member 44 occupies at least a portion of each of the recesses 40 and 42 to help retain the sprayer head 12 in the upright position.

In some forms, even when the flexible snap member 44 occupies at least part of both recesses 40 and 42, the flexible snap member 44 is still elastically flexed and would like to return to its original shape (e.g., the shape of the flexible snap member 44 in FIG. 4). The force that the flexible snap member 44 exerts in an attempt to return to the original shape helps to retain the sprayer head 12 in the rest seat of the escutcheon 24.

To promote smooth docking, both the base portion 28 of the sprayer head 12 and the bore 38 of the escutcheon 24 may have tapered walls as shown. In this way, during the docking a smaller part of the base portion 28 of the sprayer head 12 first enters the larger part of the bore 38 of the escutcheon 24. This decreases the likelihood of the edges of the components prematurely snagging on one another. Moreover, as the base portion 28 is fully seated in the bore 38 of the escutcheon 24, the sprayer head 12 is directed into a centered upright position.

Further, the combination of the tapered walls and the flexible snap member provide additional advantages. For example, in comparison to essentially vertical parallel walls, the tapered walls decrease the response time of the flexible snap member 44.

There may also be a protective washer 70 placed on the bottom of the bore 38 to prevent metal-on-metal contact between bottom of the base portion 28 and the bottom of the bore 38. The protective washer 70 may be made of a polymeric material.

Thus, the sprayer seating assembly of the present invention achieves a variety of important advantages. It helps secure the sprayer head in a proper docking position, and maintain the sprayer head in that position if accidentally bumped. Further, it helps inform the consumer when a proper docking position has been reached. Also, when the concept is used on a support that is not completely horizontal, it reduces the likelihood of sprayer head droop between uses.

What has been described thus far is merely a preferred embodiment of the invention. It should be appreciated that various other modifications could be made without departing from the spirit and scope of the invention. For example, the flexible snap member could be mounted to the base portion of the sprayer head instead of in the bore of the escutcheon. Thus, the claims should be looked to in order to judge the full scope of the invention.

INDUSTRIAL APPLICABILITY

The present invention provides improved sprayer seating assembly for docking and undocking a sprayer head from a seating area.

What is claimed is:

1. A sprayer seating assembly, comprising:

an escutcheon suitable for positioning on a surface of a support, the escutcheon having an inner surface defining a bore extending therethrough, the escutcheon also having a recess extending outwardly from the inner surface;

a sprayer head linked to a supply hose, the spray head including a recess extending inwardly from an outer surface of a base portion of the sprayer head, such that first and second portions of the outer surface of the base portion are disposed on opposing sides of the recess of the spray head; and a flexible snap member mounted in one of the recesses such that it can flex at least partially into the other recess when the recesses are aligned;

wherein when the sprayer head is not in use the escutcheon forms a rest seat for the sprayer head and the flexible snap member locks the sprayer head in a rest position relative to the escutcheon by engaging both recesses, removably retaining the sprayer head against the rest seat.

2. The sprayer seating assembly of claim 1, wherein the flexible snap member is a snap ring mounted in the recess in the escutcheon, wherein the recess in the escutcheon has an annular shape defined by a side surface, and wherein the side surface is offset outwardly from the inner surface of the escutcheon.

3. The sprayer seating assembly of claim 1, wherein the escutcheon is threaded to a tube, and the tube has mounted thereon a clamping nut such that the escutcheon and clamping nut can sandwich the support.

4. The sprayer seating assembly of claim 1, wherein the escutcheon has a tapered portion along the bore to accommodate in docking fashion a tapered portion of the base portion of the sprayer head.

5. The sprayer seating assembly of claim 4, wherein the tapered portion of the base portion substantially matches the tapered portion of the bore.

6. The sprayer seating assembly of claim 1, wherein the base portion of the sprayer head is connected to the supply hose via a ball and socket connection.

7. The sprayer seating arrangement of claim 6, wherein a filter is positioned downstream of the ball and socket connection in the sprayer head.

8. The sprayer seating assembly of claim 1, wherein a plastic washer is positioned in the bore upstream of the sprayer head.

9. The sprayer seating assembly of claim 1, wherein the flexible snap member is made of a plastic.

10. The sprayer seating assembly of claim 1, wherein the flexible snap member has a radially inward edge that is pointed, and wherein the recess of the sprayer head is shaped to complement the snap member, such that the inward edge of the snap member extends inwardly beyond the outer surface of the sprayer head and engages an inward edge of the sprayer head.

11. The sprayer seating assembly of claim 1, wherein the recesses of both the escutcheon and the sprayer head are annular, and wherein each recess includes at least two surfaces.

12. The sprayer seating assembly of claim 1, mounted to a support selected from the group consisting of essentially horizontal counter tops and essentially horizontal plumbing fixture walls.

13. The sprayer seating assembly of claim 1, wherein the first and second portions of the surface of the base portion and the recess of the sprayer head are disposed along a tapered portion of the base portion, such that the first and second portions of the surface of the base portion are coplanar, and wherein the sprayer head is in the rest position, the sprayer head extends out of a first end of the bore and the supply hose extends out of a second end of the bore.

14. The sprayer seating assembly of claim 1, wherein the base portion comprises a tapered portion extending in a substantially continuous manner to an end of the sprayer head.

15. A sprayer seating assembly, comprising:

an escutcheon having a bore and an annular recess disposed in the bore;

a sprayer head configured to removably engage the bore and including a base and an upper portion with a plurality of nozzles, the base having an annular recess disposed therein such that the recess extends into an outer surface of the sprayer head;

a supply hose fluidly connected to the base and configured to supply water to sprayer head; and a flexible snap member fixed in the sprayer head recess, such that when the sprayer head is removed from the bore of the escutcheon, the snap member remains retained in the sprayer head recess, the snap member being configured to flex to selectively engage the escutcheon recess when aligned with the sprayer head recess to removably lock the sprayer head to the escutcheon in a docked position;

wherein the bore is configured to receive the base when the sprayer head engages the escutcheon in the docked position.

16. The sprayer seating assembly of claim 15, wherein the flexible snap member has a radially inward edge that engages a complementary inward edge of the sprayer head recess.

17. The sprayer seating assembly of claim 15, wherein the escutcheon has an end configured to directly thread to a clamping nut to sandwich a support between the escutcheon and clamping nut.

18. A sprayer seating assembly, comprising:

an escutcheon having a bore and an annular groove disposed in the bore;

a sprayer head configured to removably engage the bore and including a base and an upper portion with a plurality of nozzles, the base having an annular groove disposed therein such that the groove extends into a surface of the sprayer head dividing the surface into first and second sections that are coplanar and are disposed on opposing sides of the groove;

a supply hose fluidly connected to the base and configured to supply water to sprayer head; and a flexible snap member mounted and retained in the escutcheon groove, the snap member being configured to flex to selectively engage the sprayer head groove when aligned with the escutcheon groove to removably lock the sprayer head to the escutcheon in a docked position;

wherein the bore is configured to support the base when the sprayer head engages the escutcheon.

19. The sprayer seating assembly of claim 18, wherein the flexible snap member has a radially inward edge that selectively engages a complementary inward edge of the sprayer head groove.

20. The sprayer seating assembly of claim 18, wherein the escutcheon has an end configured to directly thread to a clamping nut to sandwich a support between the escutcheon and clamping nut.

* * * * *